US008125754B2

(12) United States Patent
Shvartsman

(10) Patent No.: US 8,125,754 B2
(45) Date of Patent: Feb. 28, 2012

(54) MICRO-POWER PULSE CONTROLLER FOR MAGNETIC LATCH SOLENOIDS, RELAYS AND VALVES

(76) Inventor: Vladimir Shvartsman, Louisville (KY)

( * ) Notice: Subject to any disclaimer, the term of this patent is extended or adjusted under 35 U.S.C. 154(b) by 490 days.

(21) Appl. No.: 12/481,450

(22) Filed: Jun. 9, 2009

(65) Prior Publication Data

US 2010/0309601 A1 Dec. 9, 2010

(51) Int. Cl.
*H01H 47/00* (2006.01)

(52) U.S. Cl. ..... 361/160; 361/186

(58) Field of Classification Search ..... 361/160, 361/186

See application file for complete search history.

(56) References Cited

U.S. PATENT DOCUMENTS 4,033,444 A * 7/1977 Beery ..... 400/124.07
4,525,756 A * 6/1985 Takai et al. ..... 360/75
4,688,138 A * 8/1987 Nagata et al. ..... 361/154
7,304,828 B1 * 12/2007 Shvartsman ..... 361/93.1
7,742,273 B1 * 6/2010 Shvartsman et al. ..... 361/160
7,755,414 B2 * 7/2010 Shvartsman ..... 327/427

* cited by examiner

*Primary Examiner* — Stephen W Jackson
(74) *Attorney, Agent, or Firm* — Clifford H Kraft

(57) ABSTRACT

A solid-state magnetic latch solenoid controller which is a multi-terminal device that includes an edge (slope) detector, an adjustable one-shot pulse generator, an input status detector, two or more selectable gate drivers and output powerful MOSFETs. The controller is an extremely low-power consumption device. There is virtually no power consumption (from 1-10 uA) from an internal power source or an external source of energy during either normally closed or open stages. This maintains battery voltage and hence output condition for years. A noticeable amount of power consumed only during the transitional cycles from the open to the closed and vice versa.

16 Claims, 3 Drawing Sheets

MICRO-POWER PULSE CONTROLLER FOR MAGNETIC LATCH SOLENOIDS, RELAYS AND VALVES

BACKGROUND OF THE INVENTION

1. Field of the Invention

The present invention relates generally to electronic circuits that generate output pulses. More particularly to a controller for driving a 2-position magnetic latching solenoid or any other similar devices.

2. Description of the Prior Art

Digital magnetic latching solenoids, latching relays and solenoids are very useful and widely are used in the industrial, defense and consumer fields. The main attraction for this type of solenoid is a much less power required for operating then comparable non-latching devices. Because coils in magnetic latching devices are energized only for a short time, using non-latching devices, the applied power must be present continuously during the energized state.

There are a number of means for controlling (driving) a magnetic latching devices on the market, but most of them use microprocessor-based devices, and all of them require substantial power for operations. This has precluded existing devices from being useful for long-term, battery operation. What is badly needed is a device capable of working with a single switch to generate a corresponding output pulse.

SUMMARY OF THE INVENTION

The present invention relates to a controller for driving a 2-position magnetic latching solenoid or any other similar devices. It is adapted for use with 3-wire control magnetic latching electrically operated solenoid valves. More specifically, the present invention relates to a micro-power device designed for continuous battery power operations and installed in remote locations and/or used in long-term unattended operations.

The controller can replace many residential and light-commercial irrigation controllers such as those manufactured by Hunters Industries Inc., Hit Products Inc., Irritrol Systems, Omega Engineering Inc. and many others. It is designed for a long-terms (years) of unattended operation to automatically maintain a pressure but limited to many other similar application with two three auxiliary devices, a pressure switch, a 2-position magnetic latch solenoid valve and a power source (battery).

An embodiment of the controller containing a thermostat (temperature measuring device) can maintain temperature via controlling a heating element.

DESCRIPTION OF THE FIGURES

Attention is now directed to several figures that better described the present invention.

Several illustrations and drawings have been presented to aid in understanding the present invention. The scope of the present invention is not limited to what is shown in the figures.

DETAILED DESCRIPTION OF THE INVENTION

The controller of the present invention is designed to provide a large pulsing current onto a coil to insure a fast movement of the plunger of a solenoid. This, in turn, allows the controller to be adapted for use in activating the magnetic-latching solenoids and other similar devices.

The controller of the present invention can work with any auxiliary devices that have a dry contact (like a relay's terminal, a thermostat, or pressure switch) and a solid-state output (like a transistor). The input circuitry of the controller detects transitions from either a closed input (shorted—an input switch is turning-on); or open (an input switch is turning-off). The controller of the present invention generates an internal pulse, the duration of which can be adjusted to the required width to insure creation of a proper output pulse for activating an auxiliary device that can be any type of existing device that can be controlled by a pulse.

The controller of the present invention can detect and recognize the state of the input (either closed or open) and direct the gate control signal to the appropriate output which is a power driving device (such as a power MOSFET).

The controller of the present invention can have two outputs. Each output can independently include a powerful MOSFET or IGBT device that is capable of conducting a large amount of current with an extremely low power control signal applied onto the gate.

Figure 1:
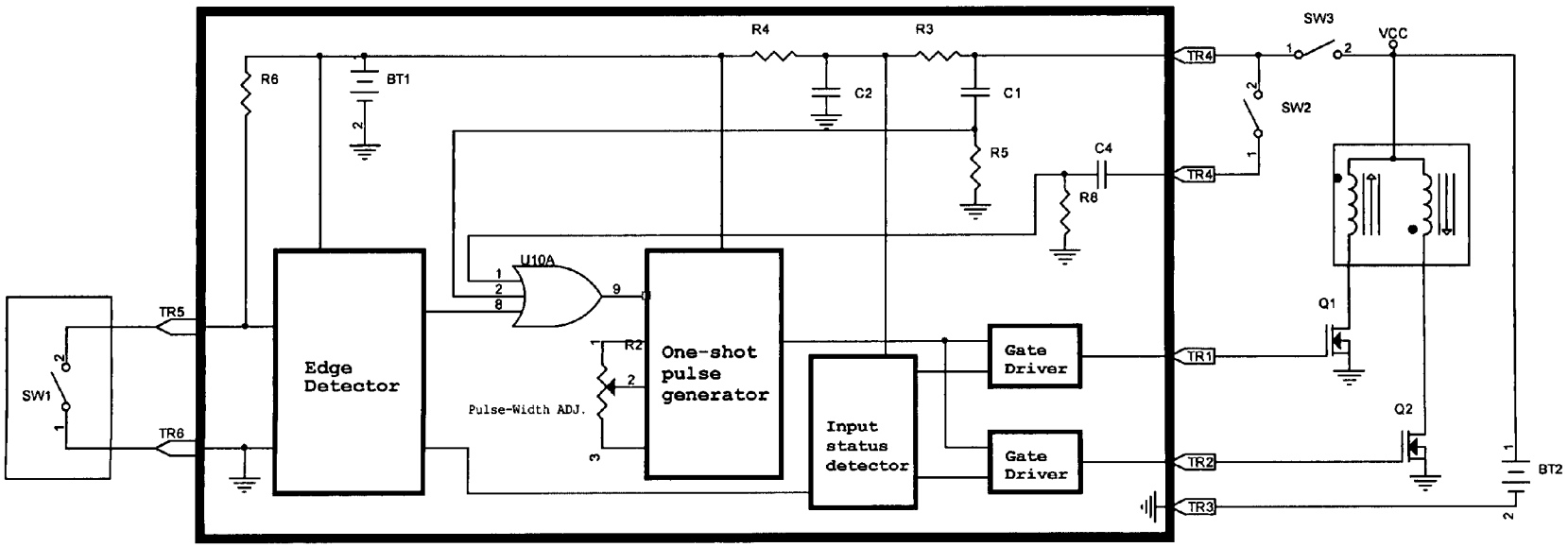
FIG. 1 is a block-diagram of an embodiment of the controller with input being an internal power source and output auxiliary devices.
Figure 2:
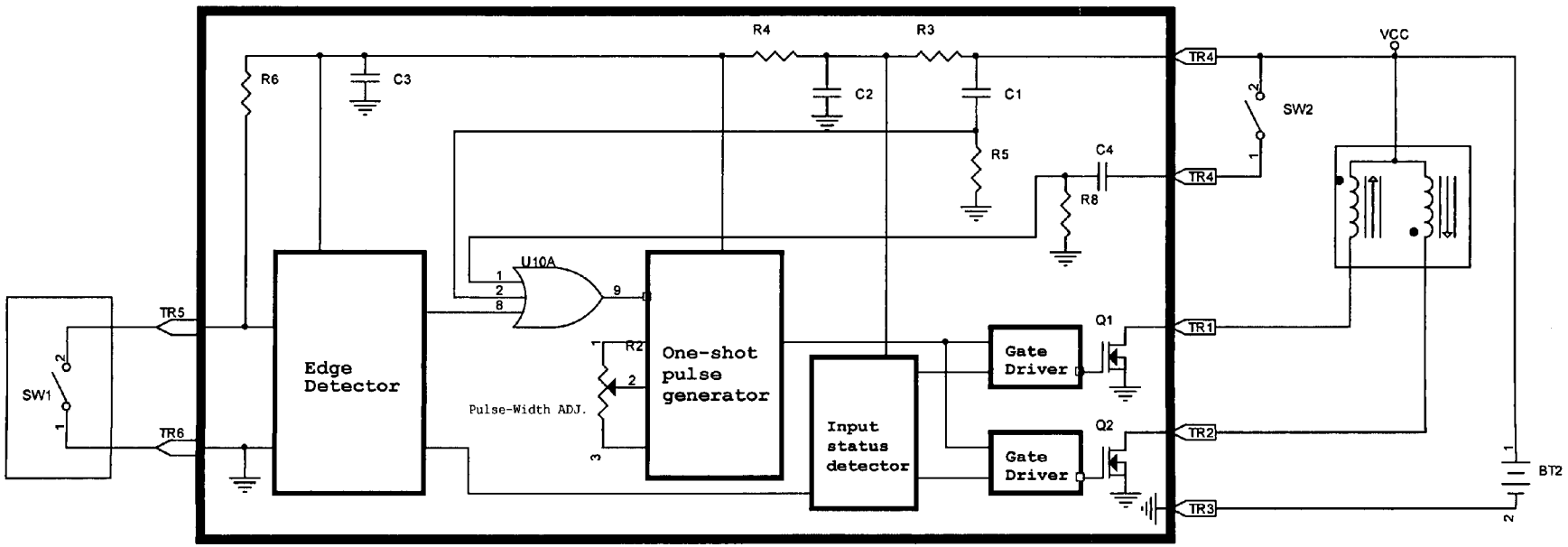
FIG. 2 is a block-diagram of another embodiment of the controller with output auxiliary devices powered by an external power source (battery).

The controller of the present invention is designed for years of operation from a low-power battery when another power source is used for driving the auxiliary load. It consumes an extremely low power and needs less then 10 uA for operation. FIG. 1 is a block-diagram of an embodiment of the controller with the input being an internal power source BT1 and output auxiliary devices powered by an external power source with power MOSFETs being external. FIG. 2 is a block-diagram of another embodiment of the controller with output auxiliary devices powered by an external power source (battery) but being internal to the controller and with the input powered externally. From FIGS. 1-2, it can be seen that an external switch (or signal) drives an edge detector that in turn drives a one-shot pulse generator. The pulse output of this generator in turn drives power gate drivers that contain either an internal high power device or external devices.

Figure 3:
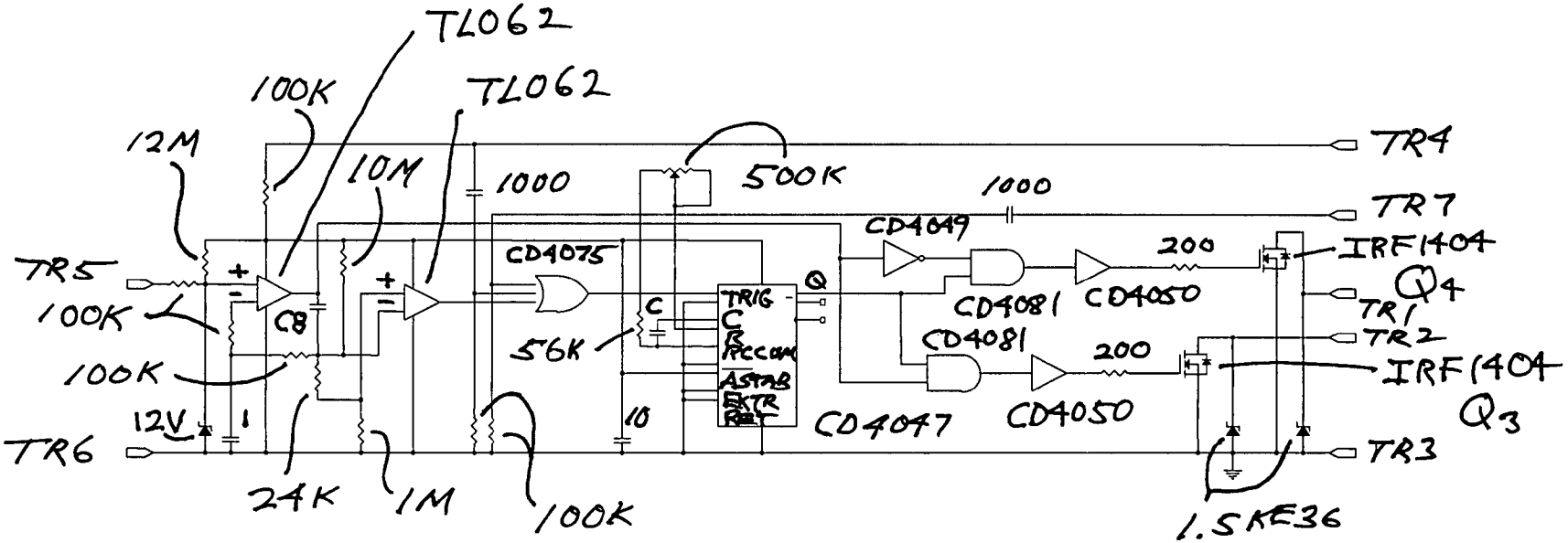
FIG. 3 is a schematic diagram of an embodiment of the controller of the present invention.

The controller is designed to minimize current consumption achieved by selecting micro-power semiconductors and selecting resistors of extremely high resistance value. Turning to FIG. 3, a schematic diagram of an embodiment of the controller of the present invention can be seen. The input auxiliary device can be a mechanical switch incorporated as a part of a pressure sensor or a temperature sensor, a magnetic sensor, or any other bio-stable device is connected the input terminals, TR5 and TR6. Any two-state signal with voltage levels near+supply and 0 volts may be used. The resistor R5 and diode D10 provide protection to the input against a voltage surge resulting from an electrostatic discharge (ESD). Resistor R22 is a 10 Meg Ohm or larger value, and external switch SW1 creates two digital values. (logical "1" or +Vcc when the switch is opened, and logical "0" or 0V when the switch is closed). Either value is applied to the input of a comparator U7A where it is compared with a reference voltage that is applied via resistor R27 and R25 from a divider. The reference voltage created by the divider R21/R26+R1. It is about 1V when Vcc is around 12 VDC. The resulting value from the pin #1 of the U7A is applied to the input status detector U6, and it is a logical "1" when the input voltage is larger than the reference voltage, and it is a logic "0" when it is smaller than the reference voltage.

During stationary operation, when the input is either maintaining an open or a closed position, the controller does nothing, and its status is very similar to a stand-by status or a "sleeping" mode. The controller reacts only when the input condition is changing (dynamic); either when the input is closing or the input is opening. The device U7A performs three functions. It works as a comparator comparing the input voltage with the reference voltage; it is a buffer amplifying an extremely a low power input voltage; and it is a formatting circuit for falling and rising slopes.

Amplified input voltage is applied onto a differential (C–R) network which consists of capacitor C8 and resistors R26/Rimp (the input impedance of the U7B) and R1. That differential network formats short duration pulses from a falling (negative going) edge and rising (positive going) edge, and inverts the negative pulse. In short, U7B performs two functions: it amplifies a positive input signal and inverts and amplifies a negative input signal thus generating two positive pulses on its output pin #7. Positive pulses via the OR gate U12A are applied onto the input of a one-shot generator U8.

The one-short generator U8, generates a narrow pulse with duration defined by around 0.73×C9×(R24+R18). The potentiometer R18, helps to set the most optimum pulse width for delivery of the right amount of power to the coil. The U8 output pulses from pin #10 are applied onto AND gates, U11A and U11B (pins #2 and pin #5 respectfully). Both AND gates along with inverter U13A perform the input status detection and direct the output pulse from U8 into the proper output channel. A first channel is chosen when the input is in a first state, and a second channel is chosen when the input is in a second state. U15A and U15B are MOSFET or other power drivers. MOSFETs are preferred because of their low on resistance; however any power output device can be used including bipolar power transistors. Also, while two channels are shown, the controller can be made with any number of channels that can be controlled by various combinations of input signals. It should be noted that while the circuit in FIG. 3 closes the output switches for the same duration of time on either state change of the input signal, it is within the scope of the present invention in some embodiments to adjust the on times of the two channels separately if desired or necessary (the pulse width of the pulse generator). Also, some embodiments of the invention can activate multiple solenoids or valves and can have more than two channels.

The controller can be reset two ways. Reset can be accomplished by an external device such as a switch or any other "smart" device remotely, or by internal circuitry during application of power onto the controller. The internal circuitry to reset the controller includes C1 and R5 as a differential network which produces a positive going pulse during the power supply (from a battery for an example) turn on. In both cases, a trigger pulse is created via the OR gate onto the input of the pulse formation circuitry on the power-up. That circuit, together with the input status detection circuit, performs an important function. It insures generation of an output drive pulse onto the corresponding output; even when the input switch is in a stationary position (either in an on or off). Generating an output pulse on a power-up eliminates a chance of a false position of a solenoid (valve) at initial connection to a power source (battery) such as replacement of an old battery or accidental power supply interruption.

Several descriptions and illustrations have been provided to aid in understanding the functioning and construction of the present invention. One with skill in the art will realize that numerous changes and variations are possible without departing from the spirit of the invention. All of these changes and variations are within the scope of the present invention.

I claim:

1. A micro-power controller for a two-state solenoid device comprising:
- an edge detector that senses a change in state in a bistable input signal producing a trigger output;
- a pulse generator that produces a pulse in response to said trigger output;
- a gating circuit gating said pulse to one of two output channels depending upon the state of said bistable input signal;
- a MOSFET power driver device in each of said output channels driving inputs to said two state solenoid device.

2. The micro-power controller of claim 1 wherein said edge detector detects both a rising edge and a falling edge.

3. The micro-power controller of claim 1 wherein said pulse generator is a one-shot device.

4. The micro-power controller of claim 1 wherein said controller draws less than 10 uA when said bistable input signal is not switching.

5. The micro-power controller of claim 1 further comprising an internal battery powering said edge detector, pulse generator and gating circuit.

6. The micro-power controller of claim 1 wherein said pulse generator's output pulse width is adjustable.

7. The micro-power controller of claim 1 wherein an output drive pulse is supplied to one of the output channels upon power-up.

8. A micro-power controller for a two-state solenoid device comprising:
- an edge detector that senses a change in state in a bistable input signal producing a trigger output by detecting both a rising and falling edge;
- a one-shot pulse generator that produces a pulse in response to said trigger output;
- a gating logic circuit gating said pulse to one of two output channels depending upon the state of said bistable input signal;
- a MOSFET power driver device in each of said output channels driving inputs to said two state solenoid device.

9. The micro-power controller of claim 8 wherein said controller draws less than 10 uA when said bistable input signal is not switching.

10. The micro-power controller of claim 8 wherein said pulse generator's output pulse width is adjustable.

11. The micro-power controller of claim 8 wherein an output drive pulse is supplied to one of the output channels upon power-up.

12. The micro-power controller of claim 8 further comprising an internal battery powering said edge detector, pulse generator and gating circuit.

13. A pulse output solenoid or valve controller comprising a circuit that closes a first power switch for a first predetermined time when an input changes from a first state to a second state and closes a second power switch for a second predetermined time when said input changes from the second state to the first state; said controller using less than 10 uA of power when said input is not changing state; and said controller closing one of said power switches for a predetermined time upon power up.

14. The pulse output solenoid or valve controller of claim 13 wherein said first predetermined time is equal to said second predetermined time.

15. The pulse output solenoid or valve controller of claim 13 wherein said power switch is a MOSFET transistor.

16. The micro-power controller of claim 13 further comprising an internal battery powering internal circuitry.

* * * * *